US010013005B1

(12) United States Patent
Ippili

(10) Patent No.: US 10,013,005 B1
(45) Date of Patent: Jul. 3, 2018

(54) LOW VOLTAGE REGULATOR

(71) Applicant: Xilinx, Inc., San Jose, CA (US)

(72) Inventor: Sharat Babu Ippili, Santa Clara, CA (US)

(73) Assignee: XILINX, INC., San Jose, CA (US)

( * ) Notice: Subject to any disclaimer, the term of this patent is extended or adjusted under 35 U.S.C. 154(b) by 0 days.

(21) Appl. No.: 15/693,028

(22) Filed: Aug. 31, 2017

(51) Int. Cl.
*G05F 1/575* (2006.01)
*G05F 1/46* (2006.01)

(52) U.S. Cl.
CPC ..... *G05F 1/461* (2013.01); *G05F 1/468* (2013.01); *G05F 1/575* (2013.01)

(58) Field of Classification Search
CPC ..... G05F 1/56; G05F 1/575
USPC ..... 323/273, 280
See application file for complete search history.

(56) References Cited

U.S. PATENT DOCUMENTS 7,495,422 B2 2/2009 Mok et al.
2002/0130646 A1* 9/2002 Zadeh ..... G05F 1/575 323/275
2014/0117957 A1* 5/2014 Usuda ..... G05F 1/569 323/280
2014/0125300 A1* 5/2014 Price ..... G05F 1/575 323/281
2015/0097534 A1* 4/2015 Bhattad ..... G05F 1/462 323/270

OTHER PUBLICATIONS

Al-Shyoukh, M. et al., "A Transient-Enhanced Low-Quiescent Current Low-Dropout Regulator With Buffer Impedance Attenuation", IEEE Journal of Solid-State Circuits, vol. 42, No. 8, pp. 1732-1742, Aug. 2007.

* cited by examiner

*Primary Examiner* — Jeffrey Sterrett
(74) *Attorney, Agent, or Firm* — W. Eric Webostad

(57) ABSTRACT

Apparatus and method relating to voltage regulation is disclosed. In an apparatus thereof, an integrated circuit includes a first differential opamp having a first gain. The first differential opamp is configured to receive a reference voltage and a feedback voltage. A second differential opamp has a second gain less than the first gain. The second differential opamp is configured to receive the reference voltage and the feedback voltage. A driver transistor is configured to provide an output voltage at an output voltage node and to receive a gating voltage output from the second differential opamp. A differential output of the first differential opamp is configured for gating a current source transistor of the second differential opamp. A capacitor is connected to the driver transistor and the current source transistor.

20 Claims, 8 Drawing Sheets

LOW VOLTAGE REGULATOR

FIELD

The following description relates to integrated circuit devices ("ICs"). More particularly, the following description relates to a low voltage regulation for an IC.

BACKGROUND

Integrated circuits have become more "dense" over time, i.e., more logic features have been implemented in an IC of a given size by having increasingly smaller process nodes, such as feature sizes equal to or less than 10 nanometers. Multigate transistors, such as MuGFETs among others, have sufficient current density while operating at low voltages to reduce power consumption. However, this has meant having to regulate supply voltages down to multigate transistor levels. Regulating low voltages is problematic with respect to providing a "clean" enough voltage for reliable operation of such small transistors, which are sensitive to even small voltage variations. Hence, it is desirable to provide an IC having enhanced low voltage regulation.

SUMMARY

An integrated circuit relates generally to voltage regulation. In such an integrated circuit, a first differential opamp having a first gain is configured to receive a reference voltage and a feedback voltage. A second differential opamp having a second gain less than the first gain is configured to receive the reference voltage and the feedback voltage. A driver transistor is configured to provide an output voltage at an output voltage node and to receive a gating voltage output from the second differential opamp. A differential output of the first differential opamp is configured for gating a current source transistor of the second differential opamp. A capacitor is connected to the driver transistor and the current source transistor.

A method relates generally to voltage regulation. In such a method, a first differential opamp having a first gain receives a reference voltage and a feedback voltage. A second differential opamp having a second gain receives the reference voltage and the feedback voltage. The second gain is less than the first gain. A driver transistor generates an output voltage at an output voltage node. For this generation, the driver transistor receives a gating voltage output from the second differential opamp, and a load current is supplied across a channel of the driver transistor for a drain node of the driver transistor connected to the output voltage node to provide the output voltage. A current source transistor of the second differential opamp is gated responsive to a differential output of the first differential opamp. The gating voltage at a gate node of the driver transistor is dampened with a capacitor connected between the gate node of the driver transistor and a drain node of the current source transistor.

Other features will be recognized from consideration of the Detailed Description and Claims, which follow.

BRIEF DESCRIPTION OF THE DRAWINGS

Accompanying drawings show exemplary apparatus(es) and/or method(s). However, the accompanying drawings should not be taken to limit the scope of the claims, but are for explanation and understanding only.

FIGS. 3-1 and 3-2 are schematic diagrams for voltage regulator of FIG. 2 for a "dc" and an "ac" domain, respectively.

DETAILED DESCRIPTION

Figure 1:
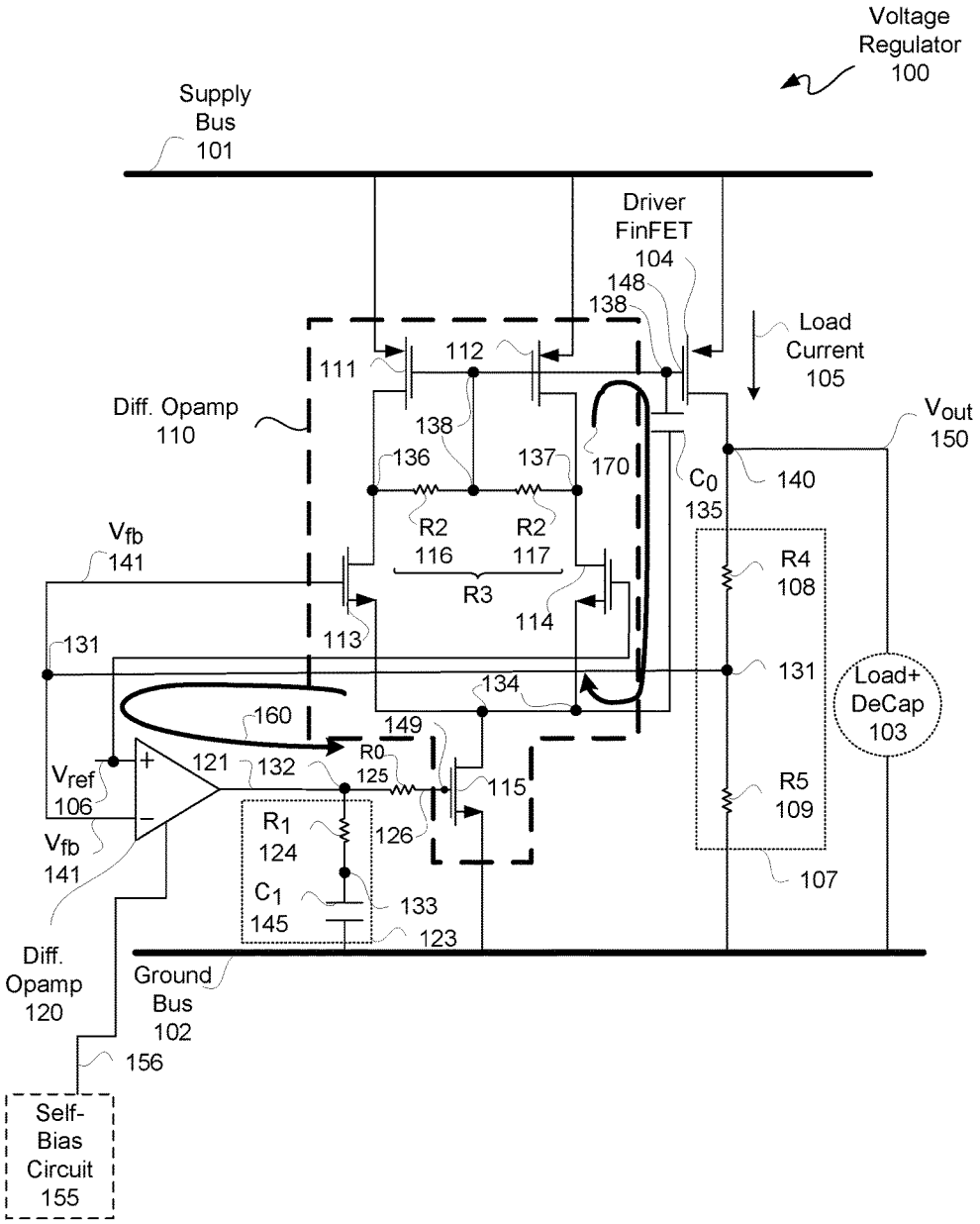
FIG. 1 is a schematic diagram depicting an exemplary voltage regulator.

In the following description, numerous specific details are set forth to provide a more thorough description of the specific examples described herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same number labels are used in different diagrams to refer to the same items; however, in alternative examples the items may be different.

Exemplary apparatus(es) and/or method(s) are described herein. It should be understood that the word "exemplary" is used herein to mean "serving as an example, instance, or illustration." Any example or feature described herein as "exemplary" is not necessarily to be construed as preferred or advantageous over other examples or features.

Before describing the examples illustratively depicted in the several figures, a general introduction is provided to further understanding.

For a semiconductor process node equal to or less than 10 nanometers, multigate transistors are operated with a supply voltage level, such as Vdd for example at 1.2 volts or less. This means on-chip or on-die voltage regulation of such low voltage levels has to respond to even small changes in dynamic load, which may be in addition to addressing supply voltage noise, reference voltage noise or changes, or other conditions affecting regulation of voltage. Moreover, for dynamic loading conditions, such as transistors switching, current load is dynamic. In addition to dynamic current loading conditions, a range of load current may be extensive for powering larger numbers of circuit components which tend to increase in number with smaller semiconductor process nodes.

Along those lines, a voltage regulator is described having two control loops. One of these control loops may be generally characterized as a "high gain slow" loop, and the other of these control loops may be generally characterized as a "low gain fast" loop. The "high gain slow" loop is used to regulate voltage components in a "low" frequency range or a "dc" domain, and the "low gain fast" loop is used to regulate voltage components is a "high" frequency range or an "ac" domain.

The "high gain slow" loop includes a differential opamp with a high gain with a dampening resistor for driving an active load or current source of a differential opamp of the "low gain fast" loop. A differential opamp of the "low gain fast" loop is directly connected to a driver circuit for driving an output voltage, which is to be contrasted to the differential opamp of the "high gain slow" loop which provides current drive to the differential opamp of the "low gain fast" loop in order to drive such driver circuit. The differential opamp of the "low gain fast" loop has a low gain and a capacitor coupled to provide an immediate feedback path into such low gain differential opamp to quickly respond to "ac" domain components in for example supply voltage and/or output voltage.

With the above general understanding borne in mind, various configurations for voltage regulation are generally described below.

FIG. 1 is a schematic diagram depicting an exemplary voltage regulator 100. In this example, voltage regulator 100 is for regulating a voltage in a range of 0.8 to 1.2 volts inclusive. However, in other example implementations, other voltage values may be used, including values less than 0.8 volts. For purposes of clarity, by "low" voltage as used herein it is generally meant a voltage of 1.2 volts ("V") or less.

Voltage regulator includes a "high gain" stage coupled to a "low gain" stage. The terms "high gain" and "low gain" are used relative to one another, and examples for the terms "high" gain and "low" gain are described below in additional detail.

In this example implementation, a differential operational amplifier ("opamp") 110 is used as a "low gain" amplifier for a "low gain" stage. More particularly, differential opamp 110 may be a single stage differential opamp with an active load. Differential opamp 110 may be thought of as a "post-driver" circuit for reasons described below in additional detail. Even though a differential opamp 110 is depicted in this example implementation, a "low gain" stage may be implemented with a diode connected load circuit, a source follower circuit, or other "low gain" circuit for a low voltage as described herein. Values or ranges described with reference to the example implementation are not necessarily used in other implementations.

Voltage regulator 100 may include an optional self-bias circuit 155, which is separately described below in additional detail for purposes of clarity and not limitation. Along those lines, a biasing current or biasing voltage may be provided internally on-die with reference to voltage regulator 100 rather than using a semiconductor integrated circuit die external source. Effectively, self-bias circuit 155 may be used to turn-on or start-up voltage regulator 100 by providing a bias voltage 156 to differential opamp 120.

In this example implementation, a differential opamp 120 is used as a "high gain" amplifier for a "high gain" stage. More particularly, differential opamp 120 may be a differential folded cascode opamp. Differential opamp 120 may be thought of as a "pre-driver" circuit for reasons described below in additional detail. In an example, differential opamp 120 may be coupled to be biased between a supply voltage level on supply bus 101 and a ground voltage level on ground bus 102 though not shown in FIG. 1 for purposes of clarity and not limitation. However, in this example, a bias voltage 156 from a self-bias circuit 155 is used to provide a supply voltage level to differential opamp 120, and thus differential opamp 120 may be coupled to be biased between a supply voltage level of bias voltage 156 and a ground voltage level on ground bus 102

Multigate transistor 104, which in this example implementation is a FinFET, has a source node connected to a supply bus 101 and a drain node connected to output voltage node 140. FinFET 104 receives a gating voltage 148 to continuously drive load current 105 across a channel of FinFET 104, though a range of load current 105 is limited by a channel of FinFET 104 and regulated by such gating voltage 148 applied to a gate node of FinFET 104. In another example, a different type of multigate transistor may be used; however, for purposes of clarity by way of non-limiting example, it shall be assumed that all transistors described with reference to voltage regulator 100 are FinFETs, unless otherwise specified. Transistors of differential opamp 120 are not particularly shown for purposes of clarity and not limitation; however, transistors of differential opamp 120 may likewise be FinFETs.

FinFET 104 is an output driver circuit coupled for driving a load current 105. Load current 105 may be supplied from supply bus 101 across a channel of FinFET 104 to output voltage node 140. FinFET 104 may be used for providing a load current 105 and an output voltage 150 to other circuitry, which is generally indicated as a load 103. Load 103 is not part of voltage regulator 100 as generally indicated by dotted lines to indicate it is in phantom.

Voltage regulator 100 may be an "on-die" voltage regulator. Accordingly, load 103 may be in a same integrated circuit die with other circuitry in which a regulated supply voltage or other regulated voltage is used as supplied by voltage regulator 100. Load 103 thus generally represents other circuitry in a same integrated circuit die in which voltage regulator 100 is located.

As FinFET 104 is an output driver circuit, channel area of FinFET 104 is substantially larger for example than that of any FinFET of differential opamp 110. In this example, FinFET 104 is to drive a load current 105 in a range of 3 to 25 milliamps, inclusive, for an output voltage ("Vout") 150 in a range of 0.8V to 1.2V. FinFET 104 may be 14 to 18 times larger than a FinFET of differential opamp 110. Additionally, for this implementation, a Vdd voltage level on supply bus 101 may be in a range of 1.35V to 1.65V, inclusive.

In this example, FinFET 104 is a PMOS driver circuit. Along those lines, negative feedback paths are used for providing inputs to NMOS FinFETs, with voltage pullups using PMOS FinFETs.

With the above description borne in mind, voltage regulator 100 is further described. Differential opamp 110 includes PMOS transistors 111 and 112, resistors 116 and 117, and NMOS transistors 113 through 115. Again, transistors 111 through 115 of differential opamp 110 may all be FinFETs or other multigate transistors. Moreover, transistors 111 through 115 may all be formed using a semiconductor process node of 10 nanometers or less.

PMOS FinFETs 111 and 112 have source nodes thereof coupled to supply bus 101. Gates nodes of PMOS FinFETs 111 and 112 are commonly connected to one another at gate bias node 138 to provide a gating voltage 148. Furthermore, a gate node of PMOS FinFET 104 is connected to gate bias node 138. A drain node of PMOS FinFET 111 is connected to a feedback-side node 136, and a drain node of PMOS FinFET 112 is connected to a reference-side node 137.

A resistor 116 having a resistance R2 is connected between nodes 136 and 138, and a resistor 117 having a resistance R2 is connected between nodes 137 and 138. Resistors 116 and 117 may be linear resistors of at least near equal resistances if not exactly equal resistances. A combined effective resistance of resistors 116 and 117 may be a resistance R3. Values of resistors 116 and 117 may be selected to provide a "dc" set point voltage level for gating voltage 148 to regulate to a target output voltage 150 for different amounts of load current. In other words, resistors 116 and 117 set a "dc" voltage level for gating voltage 148, which in combination with pullup transistors 111 and 112, ensure that FinFET 104 is continually in a saturation state, which may vary as to degree of saturation.

A drain node of NMOS FinFET 113 is connected to feedback-side node 136. A drain node of NMOS FinFET 114 is connected to reference-side node 137. A gate node of NMOS FinFET 113 is coupled to receive a feedback voltage ("Vfb") 141. In this example, feedback voltage 141 is a fraction of output voltage 150; however, in another implementation, output voltage 150 may be directly fed back as feedback voltage 141.

A gate node of NMOS FinFET 114 is coupled to receive a reference voltage ("Vref") 106. In an example implementation, reference voltage 106 may be supplied by a band-gap reference voltage circuit (not shown) for purposes of stability over a range of temperatures. In this example implementation, a band-gap reference voltage 106 from a band-gap circuit (not shown for purposes of clarity) is set equal to output voltage 150. For example, if output voltage 150 is designed to be 1V, then reference voltage 106 is set to 1V. Accordingly, for this example, reference voltage 106 may be a voltage in a range of 0.8V to 1.2V, inclusive.

Source nodes of NMOS FinFETs 113 and 114 and a drain node of NMOS FinFET 115 are commonly connected to a capacitor node or current source transistor drain node 134. A source node of NMOS FinFET 115 is connected to ground bus 102. In this example, ground bus 102 is at 0 volts. However, in another example, another value, positive or negative, may be used for a ground or Vss voltage level. A gating voltage 126 provided to a gate node 149 of NMOS FinFET 115 may be used to operate NMOS FinFET 115 as a current source, namely an N-bias as a current source transistor for biasing paths through NMOS FinFETs 113 and/or 114.

In this example implementation, a fraction of output voltage 150 is fed back as feedback voltage 141. Along those lines, a resistor ladder or resistor ladder circuit 107 in this example is formed of resistors 108 and 109 coupled in series between output voltage node 140 and ground bus 102. Resistor 108 having a resistance of R4 ohms is connected between output voltage node 140 and feedback voltage node 131. Resistor 109 having a resistance of R5 ohms is connected between feedback voltage node 131 and ground bus 102. Accordingly, a voltage divider is used to provide feedback voltage 141, namely Vout(R5/(R4+R5)).

In addition to be provided as an input to a gate node of NMOS FinFET 113, feedback voltage 141 may be provided to a minus input port of differential opamp 120. A plus input port of differential opamp 120 may be coupled to receive reference voltage 106. A difference between reference voltage 106 and feedback voltage 141 input to differential opamp 120 is amplified (i.e., divided) by a high gain of such opamp to provide a differential output voltage 121.

Differential output voltage 121 may be provided to a differential output node 132 of differential opamp 120, namely, a high pass node 132, connected to a high pass filter circuit 123. High pass filter circuit 123 may be formed of a resistor 124 having a resistance R1 and a capacitor 145 having a capacitance C1 connected in series. In this example implementation, resistor 124 is connected between high pass node 132 and internal filter node 133, and capacitor 145 is connected between internal filter node 133 and ground bus 102. Accordingly, differential output voltage 121 may be high-pass filtered by high pass filter circuit 123.

Resistor 125 may be a series resistance connected between high pass node 132 and a gate node of NMOS FinFET 115. Resistor 125 is coupled between an output of differential opamp 120 and a gate node of current source transistor 115 to provide a dampening resistance.

A filtered differential output voltage 121 may be stepped down by a voltage drop across resistor 125 having a resistance R0 for input as gating voltage 126 to NMOS FinFET 115. Resistor 125 in effect may dampen gating voltage 148 supplied by differential opamp 120 to more cleanly regulate low voltage provided as output voltage 150 in a "dc" domain. However, in another implementation, resistor 125 may be omitted, and current source transistor 115 of differential opamp 120 may be directly gated with a gating voltage 121 output from differential opamp 120.

A capacitor 135 having a capacitance C0 is connected between gate node 138 and capacitor node 134. Capacitor 135 is connected to a gate of driver FinFET 104 and a drain or drain node of current source transistor 115. Capacitor 135 is coupled to differential opamp 110 to provide a "low gain fast" loop 170. In contrast, differential opamp 120 coupled to bias a gate of NMOS FinFET 115 of differential opamp 120 is part of a "high gain slow" loop 160.

Figure 2:
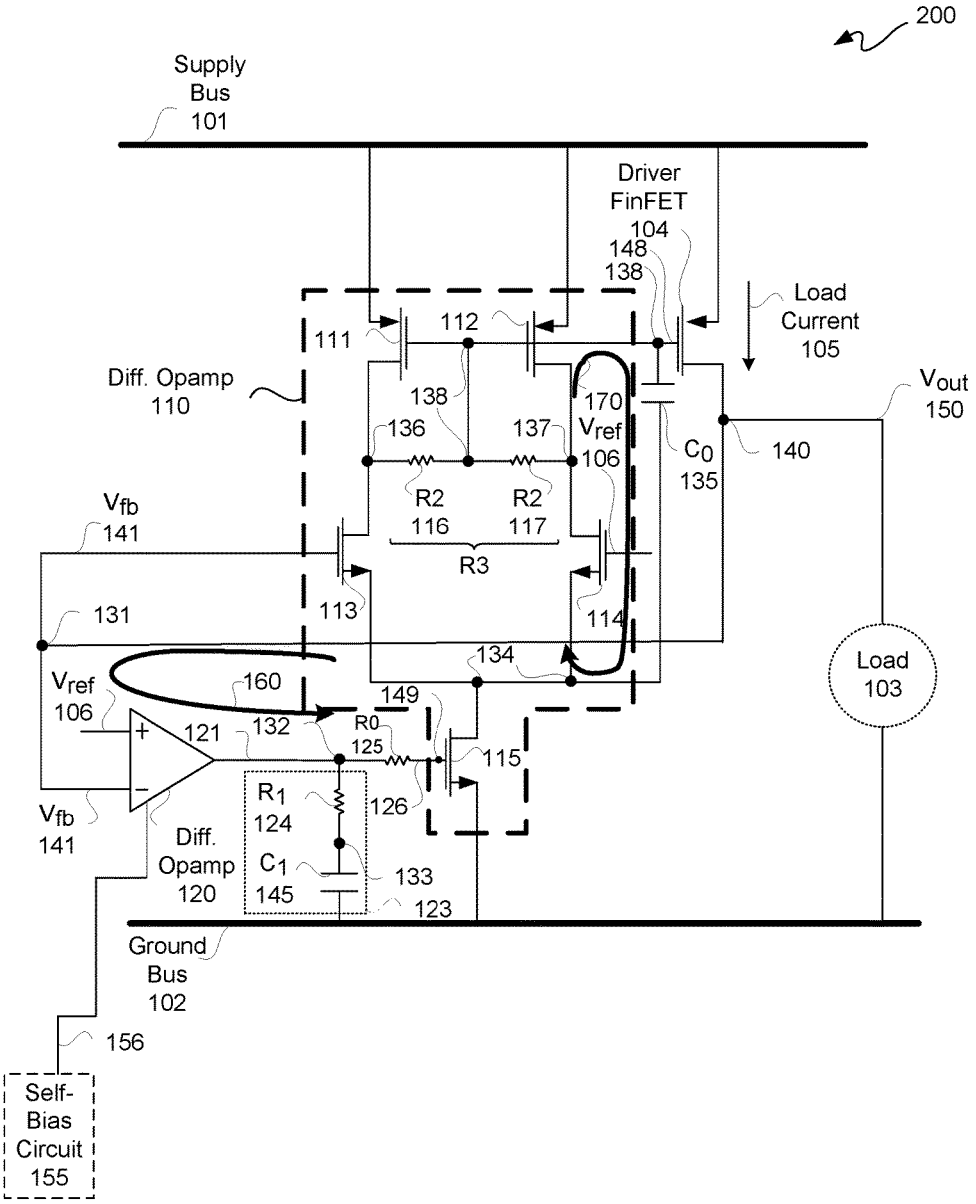
FIG. 2 is a schematic diagram depicting another exemplary voltage regulator.

FIG. 2 is a schematic diagram depicting another exemplary voltage regulator 200. Voltage regulator 200 is the same as voltage regulator 100 of FIG. 1, except for the following differences. Resistors ladder circuit 107 is omitted in voltage regulator 200. Along those lines, output voltage 150 is directly fed back as feedback voltage 141, and so output voltage node 140 is the same node as feedback voltage node 131.

Rather than a fraction of output voltage 150 being fed back as feedback voltage 141 as in voltage regulator 100 of FIG. 1, basically all of output voltage 150 is fed back as feedback voltage 141. Otherwise voltage regulator 200 of FIG. 2 is the same as voltage regulator 100 of FIG. 1, and so common description is not repeated for purposes of clarity and not limitation.

Though the following description is generally for low voltage regulator 100 of FIG. 1, such description equally applies to low voltage regulator 200. At low supply voltage levels, such as 1.2V and less, an output driver transistor, such as PMOS FinFET 104, may generally be driven by a high gain opamp, such as differential opamp 120. Such high gain differential opamp may down convert a supply voltage level on supply bus 101 to a reference voltage level of reference voltage 106. Because a high gain opamp may have a limited dynamic range at an output thereof due to a cascode output stage, such limited dynamic range may lead to degradation of an offset or difference between a reference voltage 106 and a feedback voltage 141 at an input interface to such high gain differential opamp 120.

However, by having a dual loop configured voltage regulator as described herein, a "high gain slow" opamp loop 160 is followed by a "low gain fast" opamp loop 170, the latter of which drives a load driver circuit, such as PMOS FinFET 104, which can improve offset voltage. Moreover, by having an ability to use a cascode high gain opamp 120, or more particularly for example a folded cascode high gain opamp, a "high gain slow" loop 160 may improve a power supply rejection ratio ("PSRR") at low frequencies. For the example implementation, low frequency operation or "dc" domain ripple voltage is generally less than 100 kilohertz, such as for example from 10 hertz to 100 kilohertz. The ability to use such a high gain differential opamp 120 may be afforded by having a "low gain fast" (i.e., low gain and high bandwidth) loop 170 to improve power supply rejection for low supply voltages.

Power supply rejection at a low supply voltage may be improved because frequency caused by "ac" domain impedance drives a PMOS FinFET transistor 104 driver circuit at high frequencies. For the example implementation described herein, high frequency operation or "ac" domain ripple voltage is generally 100 kilohertz to 500 megahertz.

Supply voltage on supply bus 101 may have noise. For supply voltage noise and/or ripple voltage, the latter generally due to a dynamic load 103, generally having frequencies in an "ac" domain range, such high frequency components are generally addressed by differential opamp 110. For supply voltage noise and/or ripple voltage, the latter due to a dynamic load 103, generally having frequencies in a "dc" domain range, such low frequency components are generally addressed by differential opamp 120.

Moreover, noise may be present in reference voltage 106. For noise in reference voltage 106, differential opamps 110 and 120 and corresponding feedback loops 170 and 160 may be used to reduce effects of such noise.

A low gain opamp 110 may reduce power consumption and/or output load dependence. Along those lines, capacitance C1 may be a pole of "high gain slow" control loop 170 transfer function, which may be a dominant pole of a low voltage regulator 100. Capacitance C0 is on a feed forward path, which reacts faster to a feedback voltage 141 input to differential opamp 110 than input of a negative feedback path feedback voltage 141 input to differential opamp 120 used to drive a current source transistor 115. Resistances R0 and R1 may be used to insert zeros into such transfer function for compensation in accordance with the description herein, and a resistance R3 may be used to achieve a "dc" domain gain for differential opamp 110.

To more particularly describe terms used herein, some numerical examples are provided for purposes of clarity by way of non-limiting example. Suppose a reference voltage 106 of 1.1V, an output voltage 150 of 1.0V, and a feedback voltage 141 of 0.9V are used for low voltage regulator 100. For these voltages, a high gain Av1 for differential opamp 120 may be for example 1000 (e.g., 60 dB), and a low gain Av2 for differential opamp 110 may be for example 10. A reference voltage 106 minus a feedback voltage 141 divided by a high gain is produced by differential opamp 120 as gating voltage 121. Likewise, a reference voltage 106 minus a feedback voltage 141 divided by a low gain is produced by differential opamp 130 as gating node voltage 148. Generally, a high gain Av1 will be at least a factor of 80 times greater than a low gain Av2.

Differential opamp 120 output or gating voltage 121 may have either or both an "ac" voltage component ("Vac") and a "dc" voltage component ("Vdc"). Such Vac component of gating voltage 121 is provided by a reference voltage minus a feedback voltage divided by a high gain, as previously described.

Effectively, a high gain Av1 is to be sufficiently high so as to drive down bias of a gate of N-bias FinFET 115 for a negative feedback loop, namely "high gain slow" loop 160, to drive feedback voltage 141 to a same value as reference voltage 106, namely to minimize any difference between voltages 106 and 141. A Vac component of gating voltage 121 which is provided after voltage drop by resistor 125 as gating voltage 126 to current source transistor 115 may be used to regulate current pulled down through differential opamp 110. N-bias FinFET 115 is operated in a saturation region though with differing degrees of saturation responsive to gating voltage 126 to provide a current source for differential opamp 110.

Load 103 may draw a different amount of current from time-to-time, such as different components of load 103 switch on or off for example. In this example, a range of 3 to 25 milliamps is the current drawing range of load 103. So for example, at one instant of time load 103 may draw 10 milliamps, and then in a next instant of time load may draw 22 milliamps. A change, especially a substantial abrupt change, in current drawn by load 103 can produce a step or step-like change in voltage at gating node voltage 148. For a low voltage application, a step or step-like voltage can have a significant impact, and so dampening, and quickly dampening, such step or step-like voltage may be provided by a low voltage regulator 100 to avoid or at least minimize any negative impact from such a step or step-like voltage change.

In order to dampen or generally smooth to provide more of a dampened curved response rather than a step-like or step response in voltage at gating node 148, dampening resistor 125 and/or capacitor 135 may be used. It should be understood that for load 103 operating at in a steady state, such as for example a constant 10 milliamp draw, voltage regulator 100 is in a "dc" state, namely there is no high frequency component in output voltage 150 due to changing conditions in load 103. In a "dc" domain state, output of differential opamp 120 may be a small voltage made even smaller by voltage drop across resistor 125 for a gating voltage 126 to N-bias transistor 115. In a saturation state, N-bias transistor 115 responsive to gating voltage 126 may cause a steady amount of current to be supplied to differential opamp 110 with little, if any, step or step-like change in gating voltage 148.

In such a steady state, impedance of capacitor 135, as well as impedance of capacitor 145, is high. Generally, for a "dc" domain state, capacitors 145 and 135 may have impedances sufficiently high so as to have little to no effect on operation. Along those lines, differential opamp 120 of a "high gain slow" loop 160 dominates operation of voltage regulator 100. Effectively, such a "high gain slow" loop 160, which is a negative feedback loop, sets a steady state operating point in a "dc" domain for voltage regulator 100.

However, with load 103 switching changing current draw from time-to-time, a ripple voltage may be induced at output voltage at 150. This ripple voltage in output voltage 150 may have a frequency or frequencies in an "ac" domain.

Along those lines, for a frequency component in an "ac" domain of operation of low voltage regulator 100, impedance of capacitors 135 and 145 is reduced from a high impedance state to a low impedance state relative to frequency of a ripple voltage in output voltage 150. For a low impedance provided by capacitor 135, a step or step-like curve of gating voltage 148 is dampened. This dampening may be nearly immediate as capacitor 135 is directly coupled to a gate of driver FinFET 104.

Moreover, there is just a single driver FinFET 104, which increases voltage "headroom" as there is only one transistor threshold voltage between supply bus 101 and output voltage node 140. For example, for a supply voltage of 1.35V and an output voltage of 1.20V, the difference (i.e., 0.15V) does not provide much voltage "headroom" for operating of FinFET 104 coupled between supply bus 101 and output voltage node 140. So having just a single driver transistor facilitates implementing a voltage regulator 100 capable of operating with a marginal amount of voltage "headroom."

For impedance of capacitor 145 in a low impedance state, capacitor 145 and resistor 124 in combination operate as a high pass filter to remove low frequency components in gating voltage 121 due to a high frequency component in feedback voltage 141 due to a ripple voltage in output voltage 150.

Effectively, for a ripple voltage in output voltage 150, differential opamp 110 with a "low gain fast" loop 170 dominates operation of voltage regulator 100. However, it should be understood that both "high gain slow" loop 160 and "low gain fast" loop 170 may have both "dc" and "ac" domain voltage components. However, a "dc" domain voltage component dominates operation of "high gain slow" loop 160, and an "ac" domain voltage component dominates operation of "low gain fast" loop 170.

Generally, some amount of ripple voltage is continually present in output voltage 150. Again, resistors 116 and 117 set a "dc" voltage level for gating voltage 148, which in combination with pullup transistors 111 and 112, ensure that FinFET 104 is continually in a saturation state, which may vary as to degree of saturation. Driving a gating voltage 148 directly from output of differential opamp 120 would be difficult, if not impossible, for a low output voltage due to a limit imposed by a threshold voltage of Vgs (i.e., gate-to-source voltage) of FinFET 104. As described herein, by having differential opamp 110 drive FinFET 104, pullup transistors 111 and 112, which in another configuration may be configured as fixed load diodes, provide a continuous voltage supply for gating voltage 148 independent of output voltage 150.

Accordingly, by addition of dampening capacitor 135 and/or dampening resistor 125, a quality factor, Q, for a voltage regulator 100 is increased. Thus, perturbations in output voltage 150 are effectively smoothed out for both "ac" and "dc" domains. In other words, by dampening inputs to gates of transistors 104 and 115, respectively, an output voltage 150 may likewise be dampened. Dampening output voltage 150 may be particularly useful for transistors and other devices formed with a 10 nanometer or less semiconductor process node with "thin" gate dielectrics, as such devices may be more susceptible to improper operation and/or damage due to even small perturbations in regulated supply voltage having a large effect in low voltages. "Thin" gate devices generally have a channel length of 10 or less nanometers.

Figures 1, 3:
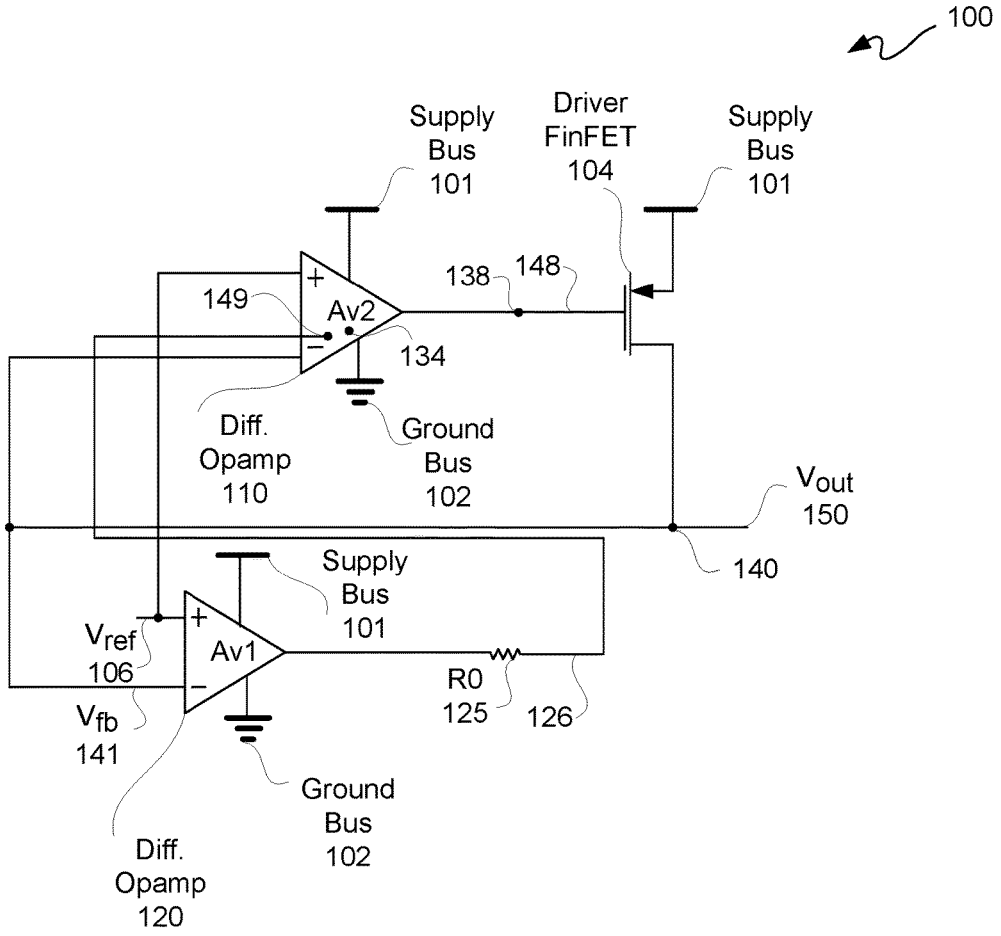
Figures 2, 3:
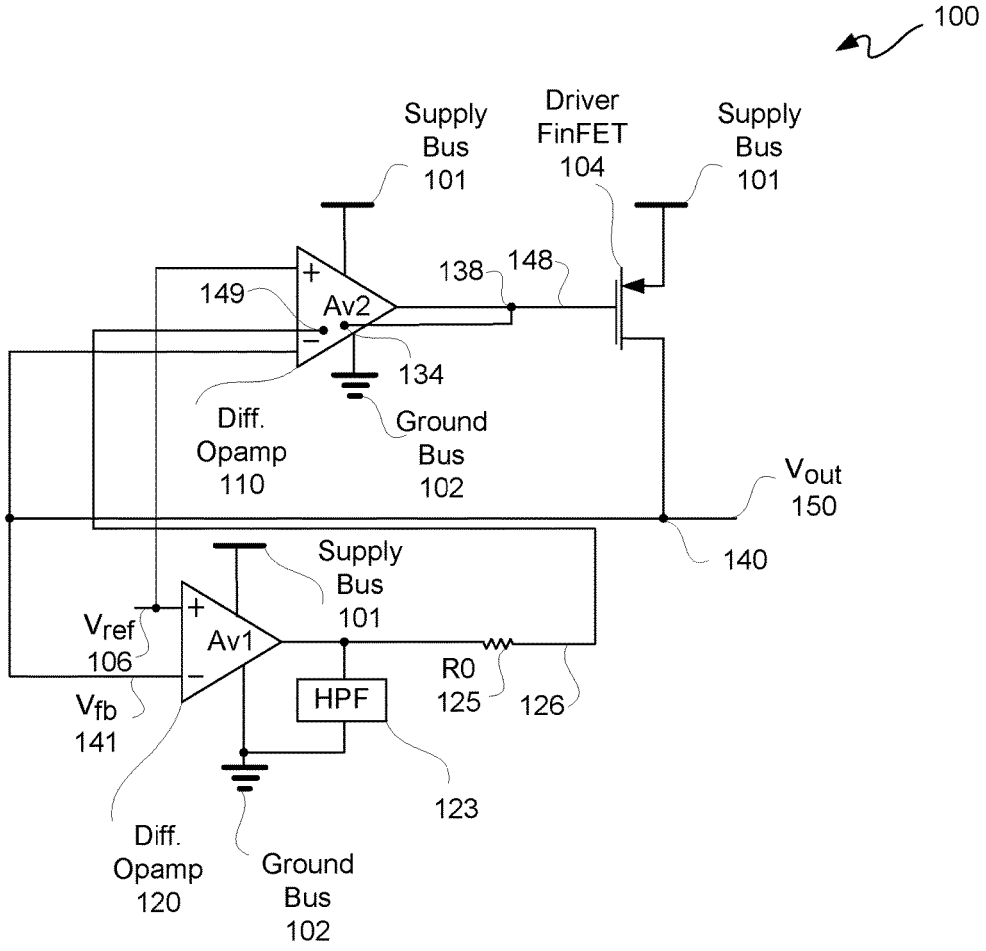

Assuming for purposes of clarity that capacitors 145 and 135 have zero impedance in an "ac" domain and have infinite impedance in a "dc" domain, even though measurable low and high, respectively, impedances would exist in such domains, operation of voltage regulator 100 or 200 may be more clearly understood. Along those lines, FIGS. 3-1 and 3-2 are schematic diagrams for voltage regulator 200 of FIG. 2 for a "dc" and an "ac" domain, respectively. Additionally, for purposes of clarity no load is illustratively depicted in FIGS. 3-1 and 3-2.

With reference to FIG. 3-1, for a "dc" domain an open circuit exists between nodes 134 and 138, and there is no high pass filter 123 coupled to output of differential opamp 110. With reference to FIG. 3-2, for an "ac" domain a short circuit exists between nodes 134 and 138, and there is a high pass filter 123 coupled to output of differential opamp 110. Accordingly, voltage regulator 200, or voltage regulator 100, is configured to dynamically operate in both a high frequency mode and a low frequency mode responsive to frequency components in supply bus 101 and/or output voltage 150.

Figure 4:
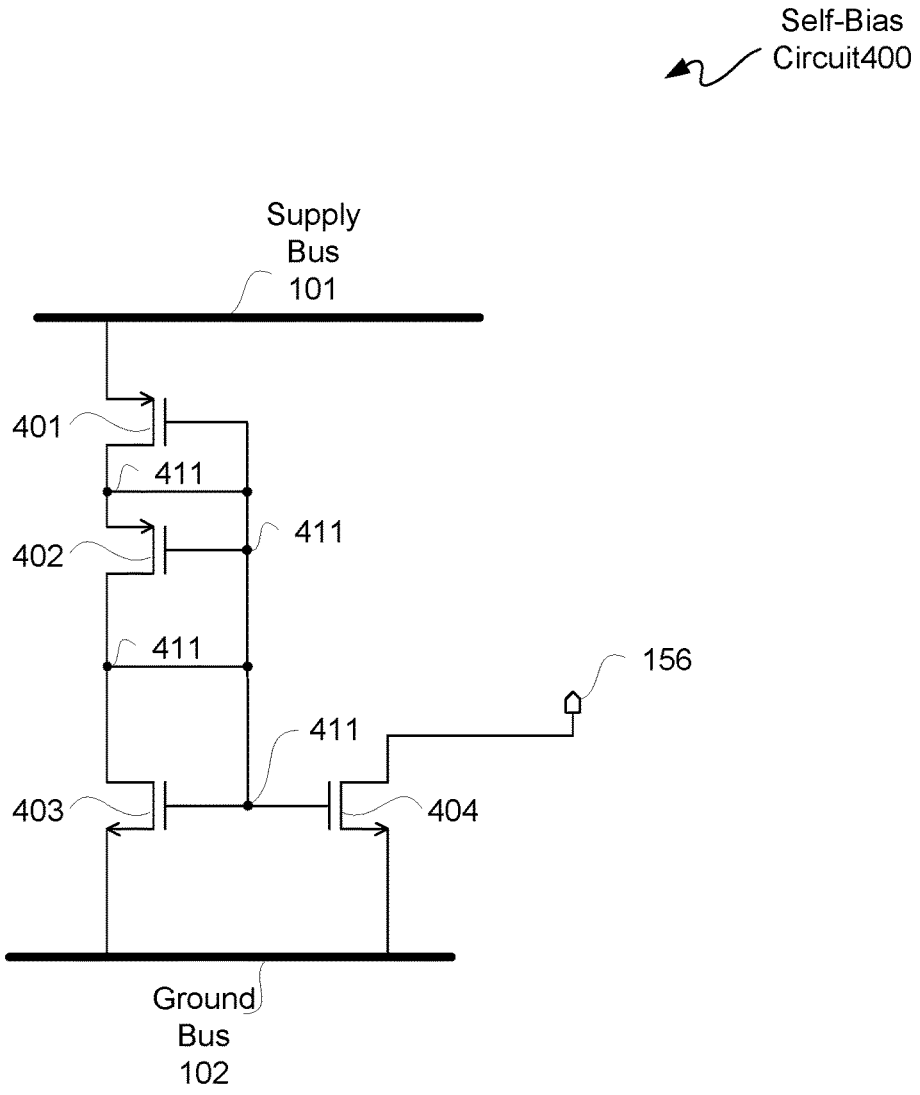
FIG. 4 is a schematic diagram depicting an exemplary self-bias circuit.

FIG. 4 is a schematic diagram depicting an exemplary self-bias circuit 400. Self-bias circuit 400, which may be self-bias circuit 155, may be coupled to a voltage regulator, such as voltage regulator 100 or 200 of FIGS. 1 and 2, respectively.

In this example, self-bias circuit 400, which may be for a cascode opamp, is coupled between supply bus 101 and ground bus 102, same as voltage regulators 100 and 200. However, in another example, same and/or different supply and ground busses may be used as between self-bias circuit 400 and a voltage regulator, such as voltage regulator 100 or 200 for example.

In this example, a source node of PMOSFET ("PMOS transistor") 401 is directly connected to supply bus 101. A drain node of PMOS transistor 401 is directly connected to a source node of PMOS transistor 402 at node 411.

In this example, drain node of PMOS transistor 402 is directly connected to a drain node of NMOSFET ("NMOS transistor") 403 at node 411. A source node of each of NMOS transistors 403 and 404 is directly connected to ground bus 102.

In this example, a gate node of each of transistors 401 through 404 is directly connected to one another at node 411. Thus, a drain node of each of transistors 401 through 403 is connected to a common gate node 411, and a source node of PMOS transistor 402 is connected to such a common gate node 411.

A drain node of NMOS transistor 404 may be used to source bias voltage 156. Bias voltage 156 may be provided to a cascode opamp, such as differential opamp 120 for example.

Figure 5:
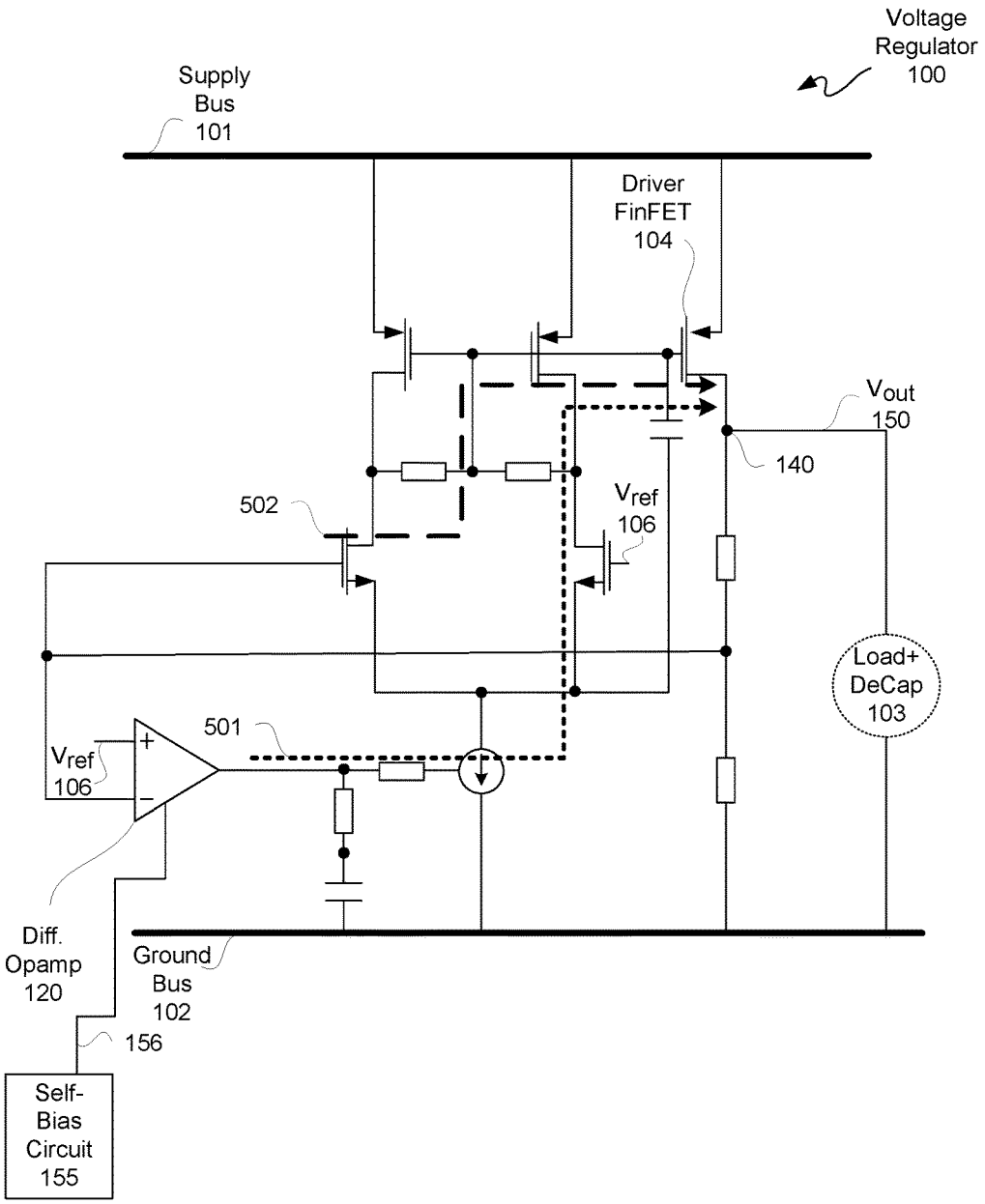
FIG. 5 is simplified version of the schematic diagram of FIG. 1 for indicating signal paths to output for the voltage regulator of FIG. 1.

FIG. 5 is simplified version of the schematic diagram of FIG. 1 for indicating signal paths 501 and 502 to output of output voltage 150 of voltage regulator 100 of FIG. 1. In another example, voltage signals respectively of signal paths 501 and 502 may be for voltage regulator 200 of FIG. 2.

For this example, it is assumed that supply voltage on supply bus 101 is 1.5 volts, output voltage 150 is 1.2 volts, and reference voltage 106 is 0.95 volts. However, these and/or other values may be used in another example.

Signal path 501 is a high bandwidth, low gain signal path for sourcing output voltage 150 from output voltage node 140. Basically, output of differential opamp 120 drives a high bandwidth, low gain signal voltage signal on signal path 501 through a reference voltage side of differential opamp 110 for gating driver FinFET 104.

Signal path 502 is a low bandwidth, high gain signal path for sourcing output voltage 150 from output voltage node 140. Basically, output of differential opamp 120 drives a low bandwidth, high gain voltage signal on signal path 502 from a feedback voltage side of differential opamp 120 for gating driver FinFET 104.

Figure 6:
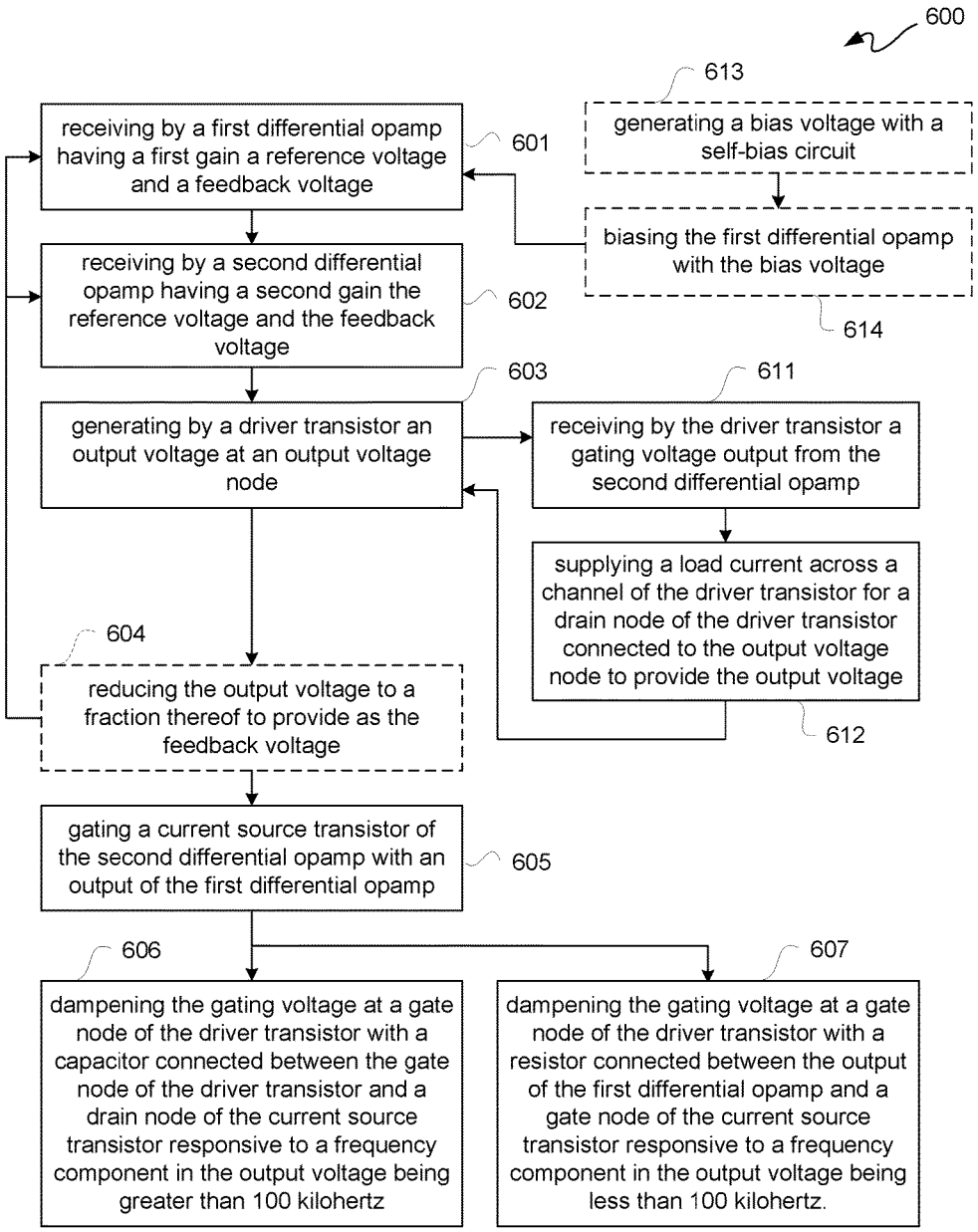
FIG. 6 is a flow diagram depicting an exemplary voltage regulation flow.

FIG. 6 is a flow diagram depicting an exemplary voltage regulation flow 600. Voltage regulation flow 600 may for example be for voltage regulator 100 or 200 respectively of FIGS. 1 and 2.

At operation 601, a first differential opamp having a first gain may receive a reference voltage and a feedback voltage as inputs respectively thereto. As previously described a differential opamp 120 may receive a reference voltage 106 and a feedback voltage 141. At the same time as operation 601, at operation 602, a second differential opamp having a second gain may receive such reference voltage and such feedback voltage. As previously described a differential opamp 110 may receive a reference voltage 106 and a feedback voltage 141. Again, a first gain Av1 is at least a factor of 80 times greater than a second gain Av2.

At operation 603, a driver transistor may generate an output voltage at an output voltage node. In the above example, a driver FinFET 104 may generate an output voltage 150 at output voltage node 140.

Operation 603 may include operations 611 and 612. At 611, a driver transistor receives a gating voltage output from a second differential opamp. For example, a driver FinFET 104 may receive a gating voltage 148 output from differential opamp 110. At 612, a load current may be supplied across a channel of a driver transistor for a drain node of such driver transistor connected to an output voltage node to provide an output voltage. In the above example, load current 105 may be supplied across a channel of driver FinFET 104 for a drain node thereof connected to output voltage node 140 to provide output voltage 150.

Optionally at operation 604, an output voltage may be reduced to a fraction thereof to provide as a feedback voltage. By fraction, it is generally meant an amount smaller than a source voltage, namely less than a source voltage. In the above example, a resistor ladder circuit 107 is used to reduce output voltage 150 to a fraction thereof to provide feedback voltage 141 as in voltage regulator 100. However, this is an option, as feedback voltage 141 may be directly coupled to output voltage node 140 as in voltage regulator 200.

At operation 605, a current source transistor of a second differential opamp may be gated responsive to an output of a first differential opamp. In the above example, a current source transistor 115 of differential opamp 110 may be gated with a gating voltage 121 directly output from differential opamp 120 or with a gating voltage 126, namely a stepped down version of gating voltage 121. In other word, in either example implementation, current source transistor 115 is gated responsive to a gating voltage 121.

At operation 606, a gating voltage at a gate node of a driver transistor may be dampened with a capacitor connected between such gate node of such driver transistor and a drain node of a current source transistor. This dampening may be responsive to a frequency component in an output voltage being greater than 100 kilohertz. Along those lines, in the above example, a gate node of driver FinFET 104 is dampened with capacitor 135 connected between a gate node of driver FinFET and a drain node of current source transistor 115 responsive to a frequency component in output voltage 150 being greater than 100 kilohertz. In other words, capacitor 135 is put in a low impedance state responsive to a frequency component in the output voltage being greater than 100 kilohertz.

At operation 607, a gating voltage at a gate node of a driver transistor is dampened with a resistor connected between an output of a first differential opamp and a gate node of a current source transistor responsive to a frequency component in an output voltage being less than 100 kilohertz. In the above example implementation, a gating voltage 148 at a gate node of a driver FinFET 104 is dampened with a resistor 125 connected between an output of a differential opamp 120 and a gate node of a current source transistor 115 responsive to a frequency component in an output voltage 150 being less than 100 kilohertz.

Optionally, at operation 613, a bias voltage may be generated with a self-bias generator, such as for example bias voltage 156 generated with self-bias circuit 155, as previously described. Optionally, at operation 614, such bias voltage may be used to bias a first differential opamp, such as previously described a differential opamp 120 may receive a bias voltage 156.

Voltage regulator 100 or 200 may be located on an integrated circuit chip or die. A large complex integrated circuit, such as a microprocessor having multiple cores, a Digital Signal Processor ("DSP"), a Field Programmable Gate Array ("FPGA"), a System-on-Chip ("SoC"), a complex Application Specific Integrated Circuit ("ASIC"), an Application Specific Standard Product ("ASSP"), or other large complex IC may having multiple on-chip voltage regulators, such as either or both of voltage regulators 100 and 200 of FIGS. 1 and 2, respectively. For purposes of clarity by way of example and not limitation, it shall be assumed that voltage regulators 100 are implemented in an FPGA. Because one or more of the examples described herein may be implemented in an FPGA, a detailed description of such an IC is provided. However, it should be understood that other types of ICs may benefit from the technology described herein.

Programmable logic devices ("PLDs") are a well-known type of integrated circuit that can be programmed to perform specified logic functions. One type of PLD, the field programmable gate array ("FPGA"), typically includes an array of programmable tiles. These programmable tiles can include, for example, input/output blocks ("IOBs"), configurable logic blocks ("CLBs"), dedicated random access memory blocks ("BRAMs"), multipliers, digital signal processing blocks ("DSPs"), processors, clock managers, delay lock loops ("DLLs"), and so forth. As used herein, "include" and "including" mean including without limitation.

Each programmable tile typically includes both programmable interconnect and programmable logic. The programmable interconnect typically includes a large number of interconnect lines of varying lengths interconnected by programmable interconnect points ("PIPs"). The programmable logic implements the logic of a user design using programmable elements that can include, for example, function generators, registers, arithmetic logic, and so forth.

The programmable interconnect and programmable logic are typically programmed by loading a stream of configuration data into internal configuration memory cells that define how the programmable elements are configured. The configuration data can be read from memory (e.g., from an external PROM) or written into the FPGA by an external device. The collective states of the individual memory cells then determine the function of the FPGA.

Another type of PLD is the Complex Programmable Logic Device, or CPLD. A CPLD includes two or more "function blocks" connected together and to input/output ("I/O") resources by an interconnect switch matrix. Each function block of the CPLD includes a two-level AND/OR structure similar to those used in Programmable Logic Arrays ("PLAs") and Programmable Array Logic ("PAL") devices. In CPLDs, configuration data is typically stored on-chip in non-volatile memory. In some CPLDs, configuration data is stored on-chip in non-volatile memory, then downloaded to volatile memory as part of an initial configuration (programming) sequence.

For all of these programmable logic devices ("PLDs"), the functionality of the device is controlled by data bits provided to the device for that purpose. The data bits can be stored in volatile memory (e.g., static memory cells, as in FPGAs and some CPLDs), in non-volatile memory (e.g., FLASH memory, as in some CPLDs), or in any other type of memory cell.

Other PLDs are programmed by applying a processing layer, such as a metal layer, that programmably interconnects the various elements on the device. These PLDs are known as mask programmable devices. PLDs can also be implemented in other ways, e.g., using fuse or antifuse technology. The terms "PLD" and "programmable logic device" include but are not limited to these exemplary devices, as well as encompassing devices that are only partially programmable. For example, one type of PLD includes a combination of hard-coded transistor logic and a programmable switch fabric that programmably interconnects the hard-coded transistor logic.

Figure 7:
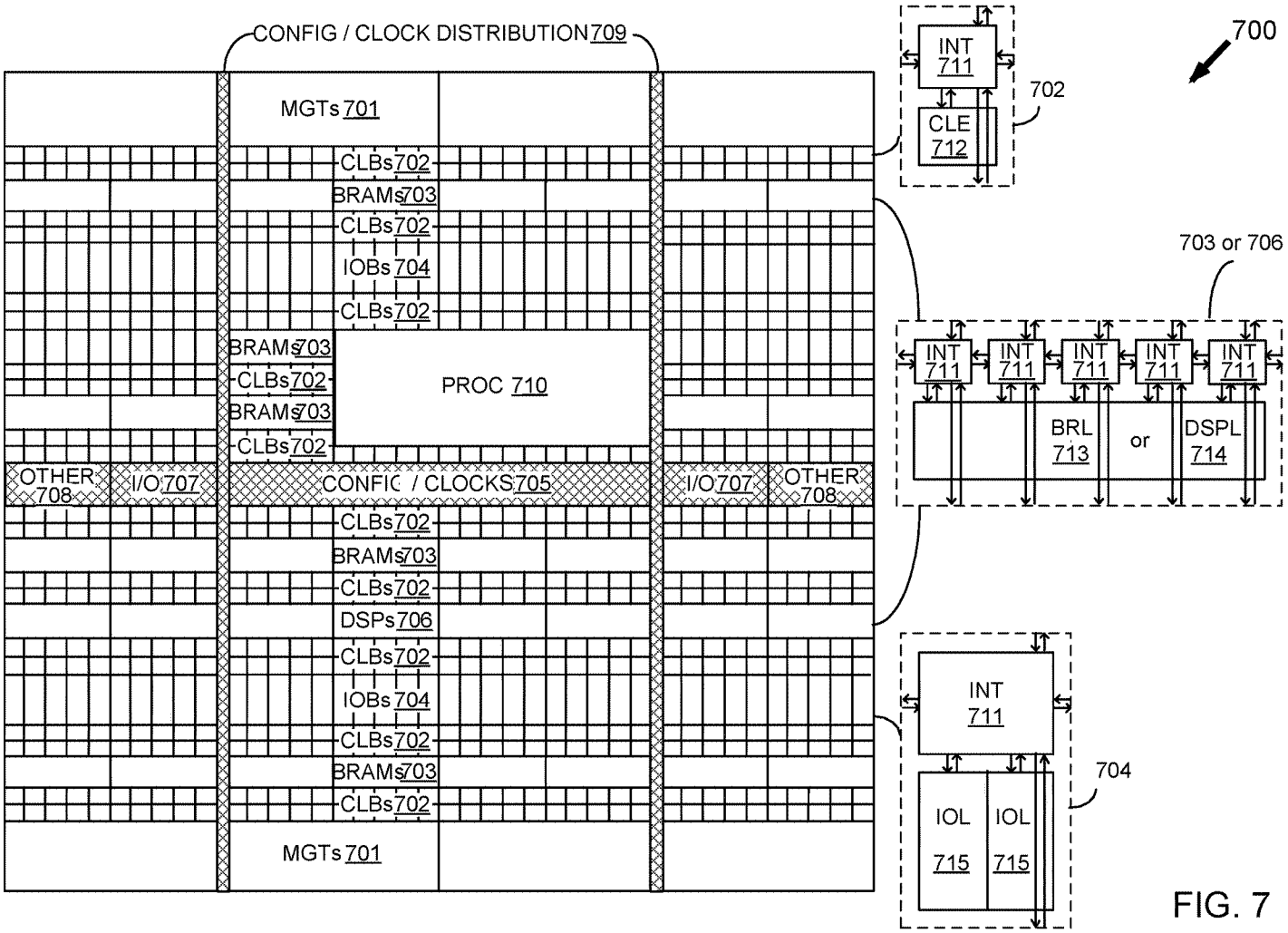
FIG. 7 is a simplified block diagram depicting an exemplary columnar Field Programmable Gate Array ("FPGA") architecture.

As noted above, advanced FPGAs can include several different types of programmable logic blocks in the array. For example, FIG. 7 illustrates an FPGA architecture 700 that includes a large number of different programmable tiles including multi-gigabit transceivers ("MGTs") 701, configurable logic blocks ("CLBs") 702, random access memory blocks ("BRAMs") 703, input/output blocks ("IOBs") 704, configuration and clocking logic ("CONFIG/CLOCKS") 705, digital signal processing blocks ("DSPs") 706, specialized input/output blocks ("I/O") 707 (e.g., configuration ports and clock ports), and other programmable logic 708 such as digital clock managers, analog-to-digital converters, system monitoring logic, and so forth. Some FPGAs also include dedicated processor blocks ("PROC") 710. Above-described circuit blocks of FPGA 700 may have voltage regulators 100 of FIG. 1.

In some FPGAs, each programmable tile includes a programmable interconnect element ("INT") 711 having standardized connections to and from a corresponding interconnect element in each adjacent tile. Therefore, the programmable interconnect elements taken together implement the programmable interconnect structure for the illustrated FPGA. The programmable interconnect element 711 also includes the connections to and from the programmable logic element within the same tile, as shown by the examples included at the top of FIG. 7. Above-described circuit blocks of FPGA 700 may have voltage regulators 100 of FIG.

For example, a CLB 702 can include a configurable logic element ("CLE") 712 that can be programmed to implement user logic plus a single programmable interconnect element ("INT") 711. A BRAM 703 can include a BRAM logic element ("BRL") 713 in addition to one or more programmable interconnect elements. Typically, the number of interconnect elements included in a tile depends on the height of the tile. In the pictured example, a BRAM tile has the same height as five CLBs, but other numbers (e.g., four) can also be used. A DSP tile 706 can include a DSP logic element ("DSPL") 714 in addition to an appropriate number of programmable interconnect elements. An 10B 704 can include, for example, two instances of an input/output logic element ("IOL") 715 in addition to one instance of the programmable interconnect element 711. As will be clear to those of skill in the art, the actual I/O pads connected, for example, to the I/O logic element 715 typically are not confined to the area of the input/output logic element 715. Above-described circuit blocks of FPGA 700 may have voltage regulators 100 of FIG. 1.

In the pictured example, a horizontal area near the center of the die (shown in FIG. 7) is used for configuration, clock, and other control logic. Vertical columns 709 extending from this horizontal area or column are used to distribute the clocks and configuration signals across the breadth of the FPGA.

Some FPGAs utilizing the architecture illustrated in FIG. 7 include additional logic blocks that disrupt the regular columnar structure making up a large part of the FPGA. The additional logic blocks can be programmable blocks and/or dedicated logic. For example, processor block 710 spans several columns of CLBs and BRAMs.

Note that FIG. 7 is intended to illustrate only an exemplary FPGA architecture. For example, the numbers of logic blocks in a row, the relative width of the rows, the number and order of rows, the types of logic blocks included in the rows, the relative sizes of the logic blocks, and the interconnect/logic implementations included at the top of FIG. 7 are purely exemplary. For example, in an actual FPGA more than one adjacent row of CLBs is typically included wherever the CLBs appear, to facilitate the efficient implementation of user logic, but the number of adjacent CLB rows varies with the overall size of the FPGA.

While the foregoing describes exemplary apparatus(es) and/or method(s), other and further examples in accordance with the one or more aspects described herein may be devised without departing from the scope hereof, which is determined by the claims that follow and equivalents thereof. Claims listing steps do not imply any order of the steps. Trademarks are the property of their respective owners.

What is claimed is:

1. An integrated circuit for voltage regulation, comprising:

a first differential opamp having a first gain configured to receive a reference voltage and a feedback voltage;

a second differential opamp having a second gain less than the first gain configured to receive the reference voltage and the feedback voltage;

a driver transistor configured to provide an output voltage at an output voltage node and to receive a gating voltage output from the second differential opamp;

a differential output of the first differential opamp configured for gating a current source transistor of the second differential opamp; and a capacitor connected to the driver transistor and the current source transistor.

2. The integrated circuit according to claim 1, further comprising a resistor coupled between an output node of the first differential opamp and a gate node of the current source transistor.

3. The integrated circuit according to claim 1, wherein the capacitor is connected to a gate node of the driver transistor and a drain node of the current source transistor.

4. The integrated circuit according to claim 3, further comprising a resistor coupled between an output node of the first differential opamp and a gate node of the current source transistor.

5. The integrated circuit according to claim 4, further comprising a high pass filter coupled between the output node of the first differential opamp and a ground bus.

6. The integrated circuit according to claim 5, further comprising a self-bias circuit configured to provide a bias voltage to the first differential opamp.

7. The integrated circuit according to claim 5, wherein the first gain is at least a factor of times 80 greater than the second gain.

8. The integrated circuit according to claim 5, further comprising a resistor ladder connected between the output voltage node and the ground bus and configured to provide the feedback voltage as a fraction of the output voltage.

9. The integrated circuit according to claim 5, wherein the output voltage is the feedback voltage.

10. The integrated circuit according to claim 5, wherein the driver transistor is a multigate transistor.

11. The integrated circuit according to claim 5, wherein the current source transistor is a multigate transistor.

12. The integrated circuit according to claim 5, wherein the first differential opamp is a differential folded cascode opamp.

13. The integrated circuit according to claim 12, wherein the second differential opamp is a single stage differential opamp.

14. A method for voltage regulation, comprising:

receiving a reference voltage and a feedback voltage by a first differential opamp having a first gain;

receiving the reference voltage and the feedback voltage by a second differential opamp having a second gain less than the first gain;

generating by a driver transistor an output voltage at an output voltage node, the generating comprising:

receiving by the driver transistor a gating voltage output from the second differential opamp; and supplying a load current across a channel of the driver transistor for a drain node of the driver transistor connected to the output voltage node to provide the output voltage;

gating a current source transistor of the second differential opamp responsive to a differential output of the first differential opamp; and dampening the gating voltage at a gate node of the driver transistor with a capacitor connected between the gate node of the driver transistor and a drain node of the current source transistor.

15. The method according to claim 14, wherein the dampening comprises putting the capacitor in a low impedance state responsive to a frequency component in the output voltage being greater than 100 kilohertz.

16. The method according to claim 15, wherein the output voltage is in a range of 0.8 to 1.2 volts, and wherein the load current is in a range of 3 to 25 milliamps.

17. The method according to claim 15, wherein the dampening is first dampening, the method further comprising:

second dampening the gating voltage at the gate node of the driver transistor with a resistor connected between an output node of the first differential opamp and a gate node of the current source transistor.

18. The method according to claim 17, wherein the second dampening is responsive to the frequency component in the output voltage being less than 100 kilohertz.

19. The method according to claim 14, further comprising reducing the output voltage to a fraction thereof to provide as the feedback voltage.

20. The method according to claim 14, further comprising:

generating a bias voltage with a self-bias circuit; and biasing the first differential opamp with the bias voltage.

* * * * *